US009169059B2

(12) United States Patent
Shen

(10) Patent No.: US 9,169,059 B2
(45) Date of Patent: Oct. 27, 2015

(54) CONTAINER FOR HOUSING OPTICAL INSTRUMENTS

(71) Applicant: Dar-Tson Shen, West Vancouver (CA)

(72) Inventor: Dar-Tson Shen, West Vancouver (CA)

(73) Assignee: Suzhou Synta Optical Technology Co., Ltd., Jiangsu (CN)

( * ) Notice: Subject to any disclaimer, the term of this patent is extended or adjusted under 35 U.S.C. 154(b) by 91 days.

(21) Appl. No.: 14/054,428

(22) Filed: Oct. 15, 2013

(65) Prior Publication Data

US 2015/0101947 A1 Apr. 16, 2015

(51) Int. Cl.

| | |
|---|---|
| ***B65B 23/00*** | (2006.01) |
| ***B65D 85/38*** | (2006.01) |
| ***A45C 11/08*** | (2006.01) |
| ***B65B 5/04*** | (2006.01) |
| ***B65B 23/22*** | (2006.01) |
| ***B65B 55/20*** | (2006.01) |
| ***B65D 81/107*** | (2006.01) |

(52) U.S. Cl.

CPC ..... *B65D 85/38* (2013.01); *A45C 11/08* (2013.01); *B65B 5/04* (2013.01); *B65B 23/22* (2013.01); *B65B 55/20* (2013.01); *B65D 81/107* (2013.01)

(58) Field of Classification Search

CPC .... B65B 55/20; B65B 7/2842; B65B 7/2857; B65B 7/285; B65D 81/107; B65D 81/052; B65D 5/4233; B65D 5/563

See application file for complete search history.

(56) References Cited

U.S. PATENT DOCUMENTS

| | | | | | |
|---|---|---|---|---|---|
| 848,889 | A | * | 4/1907 | Fitzgerald | 190/16 |
| 2,282,908 | A | * | 5/1942 | Thompson | 206/523 |
| 2,655,369 | A | | 10/1953 | Musilli | |
| 2,660,295 | A | | 11/1953 | Beck | |
| 2,979,246 | A | * | 4/1961 | Liebeskind | 206/523 |
| 3,003,622 | A | | 10/1961 | Hardigg | |
| 3,163,312 | A | * | 12/1964 | Chaplin | 217/26.5 |
| 3,222,843 | A | * | 12/1965 | Schneider | 53/449 |
| 3,356,209 | A | * | 12/1967 | Pezely, Jr. | 206/523 |
| 3,381,782 | A | * | 5/1968 | Ikelheimer | 206/593 |
| 3,399,797 | A | * | 9/1968 | Freeman | 217/52 |

(Continued)

FOREIGN PATENT DOCUMENTS

| | | |
|---|---|---|
| DE | 202008015008 | 10/2009 |
| GB | 12358 | 0/1911 |

(Continued)

OTHER PUBLICATIONS iBallz, http://www.iballz.info/products/hard-case, Jul. 10, 2012.

*Primary Examiner* — Sameh Tawfik

(74) *Attorney, Agent, or Firm* — Todd A. Rattray; Oyen Wiggs Green & Mutala LLP

(57) ABSTRACT

A container for housing optical instruments is described. The container includes a case having an interior surface shaped to define a container cavity for holding an optical instrument. The interior surface is further shaped to define a plurality of ball-receiving concavities which open into the container cavity. Each ball-receiving concavity is shaped to have an opening at its edge and an interior region. The container also includes a plurality of elastically deformable balls, each ball located in a corresponding ball-receiving concavity and projecting from the interior region of the corresponding ball-receiving concavity through the opening and into the container cavity such that the balls are deformed to accommodate the optical instrument in the container cavity.

10 Claims, 6 Drawing Sheets

(56) References Cited

U.S. PATENT DOCUMENTS

| | | | | | |
|---|---|---|---|---|---|
| 3,546,055 | A | * | 12/1970 | Spertus | 428/52 |
| 3,708,084 | A | * | 1/1973 | Bixler et al. | 217/26.5 |
| 169,442 | A | | 11/1975 | Horton | |
| 4,093,010 | A | | 6/1978 | Hunley et al. | |
| 4,162,696 | A | | 7/1979 | Sprung | |
| 4,179,979 | A | * | 12/1979 | Cook et al. | 89/36.02 |
| 4,184,306 | A | * | 1/1980 | Grasson | 53/240 |
| 4,240,240 | A | | 12/1980 | Cohen | |
| 4,340,139 | A | * | 7/1982 | Wilcox et al. | 206/349 |
| 4,615,464 | A | * | 10/1986 | Byrns | 220/4.23 |
| 4,880,214 | A | * | 11/1989 | Sukai | 267/136 |
| 5,299,722 | A | * | 4/1994 | Cheney | 224/404 |
| 5,638,662 | A | | 6/1997 | Alhamad | |
| 5,950,833 | A | * | 9/1999 | James | 206/522 |
| 5,996,749 | A | * | 12/1999 | Hillsberg et al. | 190/109 |
| 6,722,502 | B1 | | 4/2004 | Newman | |
| 7,044,303 | B2 | * | 5/2006 | Van Der Werf | 206/586 |
| 8,210,388 | B2 | * | 7/2012 | Logan et al. | 220/560.01 |
| 2011/0049004 | A1 | | 3/2011 | Mena et al. | |

FOREIGN PATENT DOCUMENTS

| | | |
|---|---|---|
| GB | 890484 | 2/1962 |
| GB | 2416348 | 1/2006 |

* cited by examiner

CONTAINER FOR HOUSING OPTICAL INSTRUMENTS

TECHNICAL FIELD

This invention relates to containers, more specifically to containers for housing and transporting optical instruments while mitigating damage to the optical instruments.

BACKGROUND

Typically, an optical instrument is transported (e.g. shipped or otherwise moved from location to location) by housing the optical instrument in a box or container lined with conventional packaging material such as foam, EPE foam, packing paper, bubble wrap or the like. During transport of the instrument, the box may experience shocks, which may cause associated shock forces to be transmitted through the box and to the optical instrument. Further, the optical instrument may move inside the box, collide with the sidewalls of the box and experience associated collision forces. Such shock forces and/or collision forces may be harmful to the optical instrument.

Different techniques have been used to reduce the forces experienced by optical instruments during transport inside such boxes. For example, the box may be filled with "peanut foam" which may reduce movement of the optical instrument inside the box and reduce the forces transmitted to the optical instrument. However, peanut foam may settle or otherwise move around inside the box during transport, leaving parts of the optical instrument unprotected.

There remains a general desire for more effective ways to house and transport optical instruments while mitigating damage to the optical instruments.

SUMMARY

The invention has a number of aspects. One aspect provides a container for housing an optical instrument. The container comprises an interior surface shaped to define a container cavity, the container cavity sized to accommodate the optical instrument. The interior surface is shaped to define a plurality of ball-receiving concavities which open into the container cavity, each ball-receiving concavity having an opening at an edge between the ball-receiving concavity and the container cavity and an interior region inside the ball-receiving concavity. The container comprises a plurality of elastically deformable balls, each ball located in a corresponding one of the ball-receiving concavities and projecting from the interior region of the corresponding one of the ball-receiving concavities through the opening of the corresponding one of the ball-receiving concavities and into the container cavity such that the balls are deformed to accommodate the optical instrument in the container cavity.

Another aspect of the invention comprises a method for transporting an optical instrument. The method comprises: providing a container for housing an optical instrument, the container comprising an interior surface shaped to define a container cavity, the container cavity sized to accommodate the optical instrument, the interior surface further shaped to define a plurality of ball-receiving concavities which open into the container cavity, each ball-receiving concavity having an opening at an edge between the ball-receiving concavity and the container cavity and an interior region inside the ball-receiving concavity; providing a plurality of elastically deformable balls, each ball located in a corresponding one of the ball-receiving concavities and projecting from the interior region of the corresponding one of the ball-receiving concavities through the opening of the corresponding one of the ball-receiving concavities and into the container cavity; and inserting the optical instrument into the container concavity and thereby deforming the plurality of balls.

Further aspects of the invention and non-limiting example embodiments of the invention are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Aspects of the invention provide containers for housing optical instruments. An optical instrument container comprises an interior surface, which defines a container cavity for accommodating the optical instrument. The interior surface also defines a plurality of ball-receiving concavities, which open into the container cavity. An elastically deformable ball is located in each ball-receiving concavity. Each ball is sized such that it projects from an interior region of its corresponding ball-receiving concavity through an opening of its corresponding ball-receiving concavity and into the container cavity such that the balls are deformed to accommodate the optical instrument in the container cavity.

Figure 1:
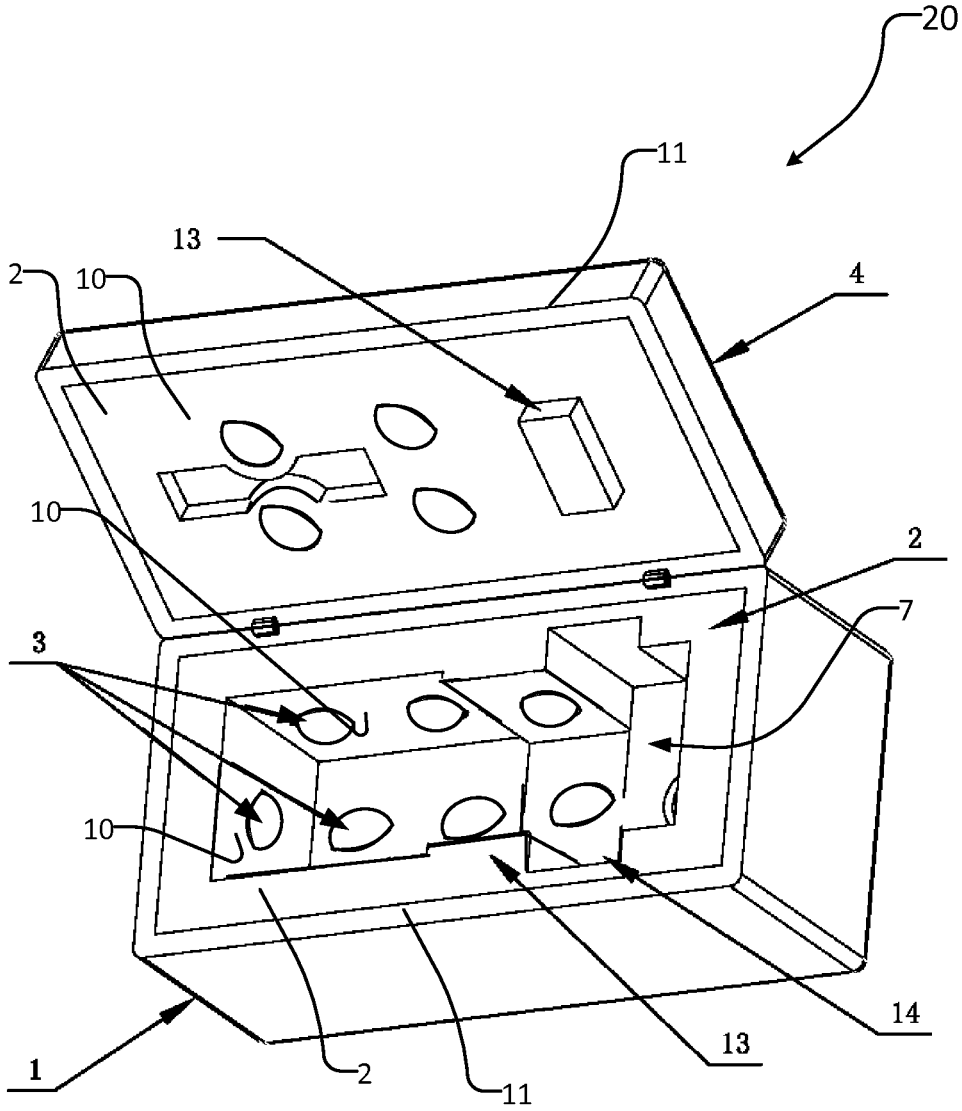
FIG. 1 is a perspective view of a case and a cover of a container for housing an optical instrument according to an embodiment of the present invention.
Figure 2:
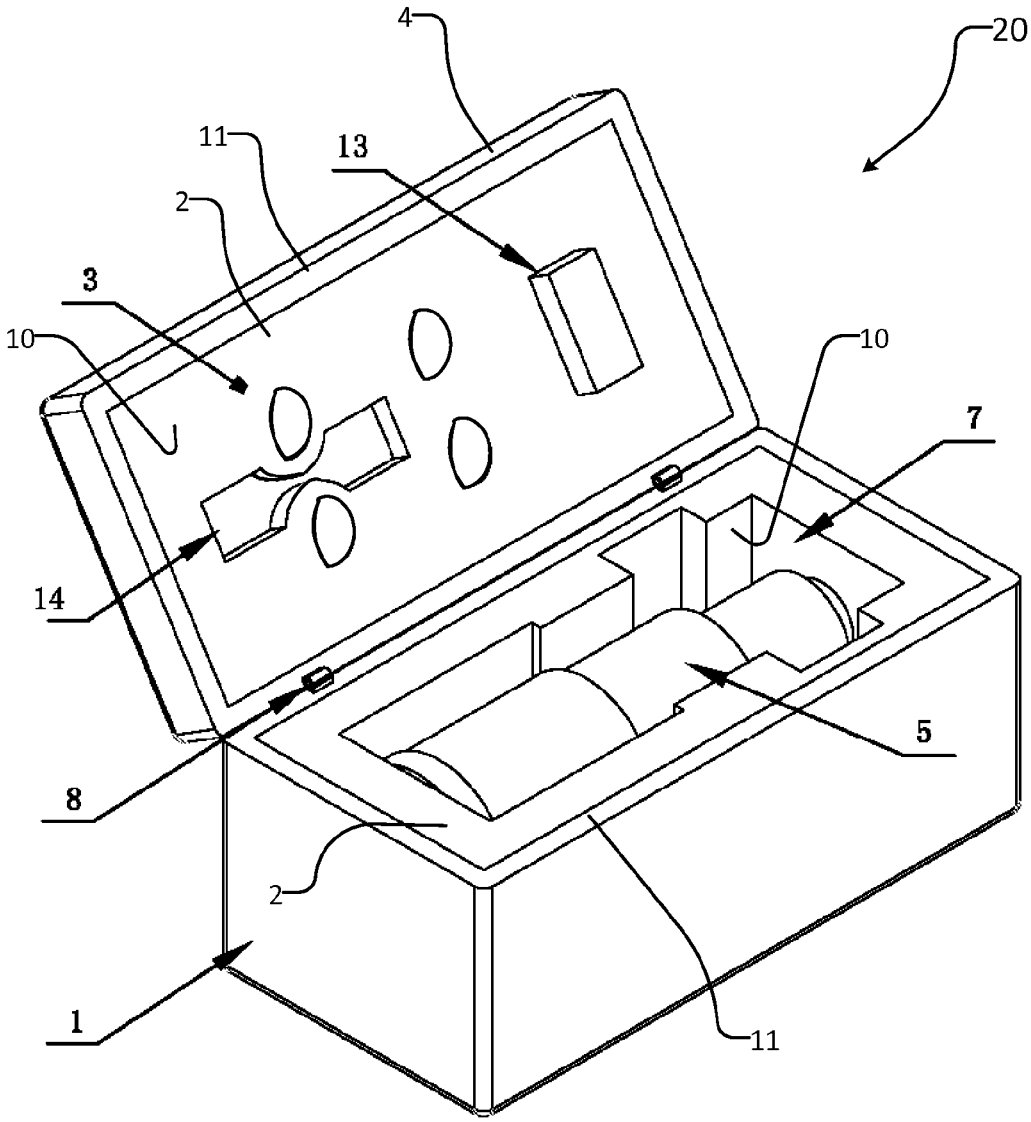
FIG. 2 is a perspective view of the FIG. 1 container showing an optical instrument housed therein.
Figure 3:
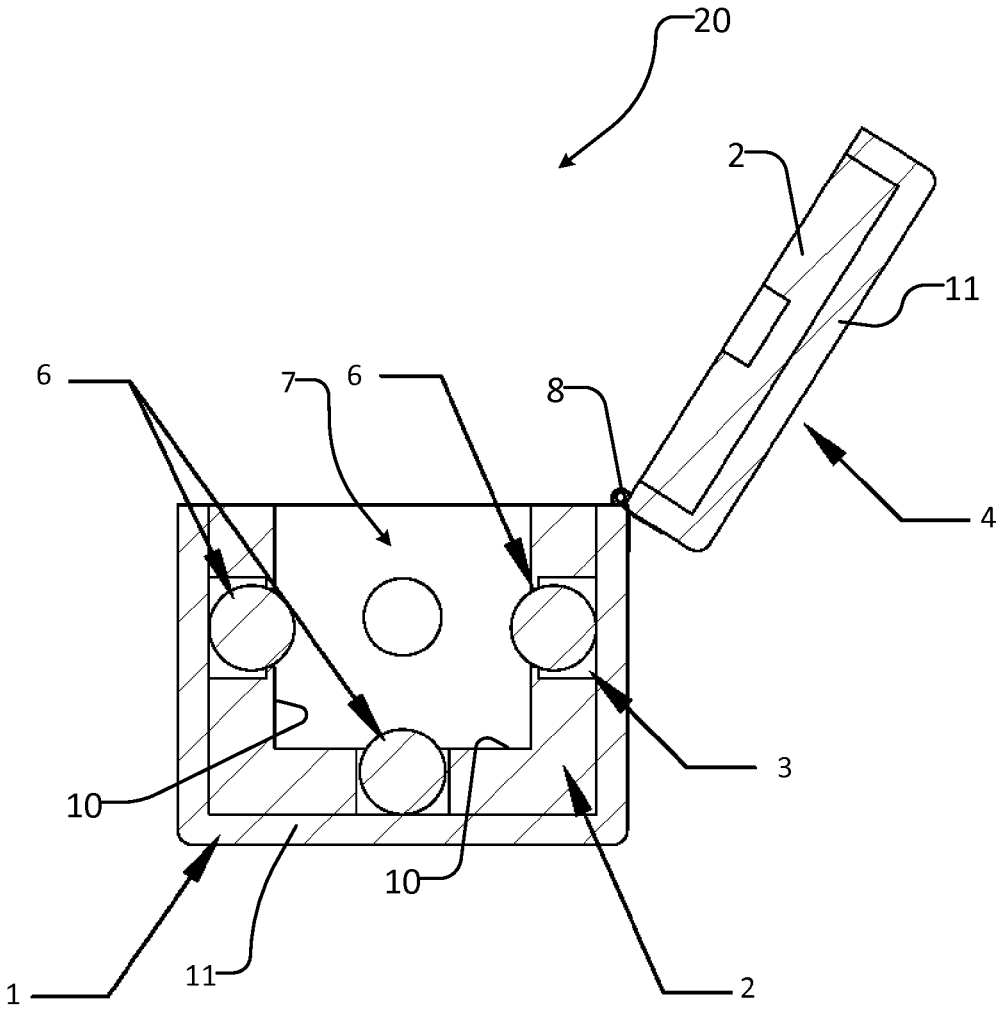
FIG. 3 is a side cross-sectional view of the FIG. 1 container.

FIGS. 1-3 show various views of a container 20 according to an example embodiment. Container 20 of the illustrated embodiment comprises a case body 1 and a cover 4. Case body 1 and cover 4 may be made from the same material or may be made from different material. In the illustrated embodiment, cover 4 is coupled to case body 1 by hinges 8, such that container 20 may be opened by moving cover 4 relative to case body 1 at hinges 8. In some embodiments, container 20 may comprise a latch or the like (not shown) for locking container 20 in a closed configuration. In some embodiments, cover 4 is foldable relative to case body 1 to open and close container 20. In some embodiments, cover 4 is provided separately from case body 1, in which case container may be closed by attaching cover to case body 1 and opened by removing cover 4 from case body 1.

Case body 1 and/or cover 4 may comprise several layers of material. For example, in the case of the illustrated embodiment, case body 1 and cover 4 comprise a relatively hard exterior layer 11 (e.g. suitable metal, plastic and/or the like) and a relatively soft interior layer 2 (e.g. foam, EPE foam and/or the like). Exterior layers 11 and interior layers 2 may be of different thicknesses than one another. Exterior layer 11 and/or interior layer 2 of case body 1 may have different thicknesses than exterior layer 11 and/or interior layer 2 of cover 4. In some embodiments, case body 1 and/or cover 4 may comprise a single layer of material or more than two layers of material. In some embodiments, case body 1 and cover 4 may comprise different numbers of layers of material.

Interior layers 2 and/or exterior layers 11 of case body 1 and cover 4 provide a interior surface 10, which defines a container cavity (i.e. an instrument-housing space) 7 for housing an optical instrument 5. Case body 1 and cover 4 (and/or the interior surface 10 thereof) may be shaped and/or sized such that container cavity 7 accommodates a particular optical instrument 5. FIG. 2 shows an optical instrument 5 located in container cavity 7. In the example embodiment shown in FIG. 2, optical instrument 5 is a telescope, although it will be appreciated that container 20 and/or its interior surface 10 could be designed so that container cavity 7 could accommodate other optical instruments having different shapes and/or sizes.

Figure 7A:
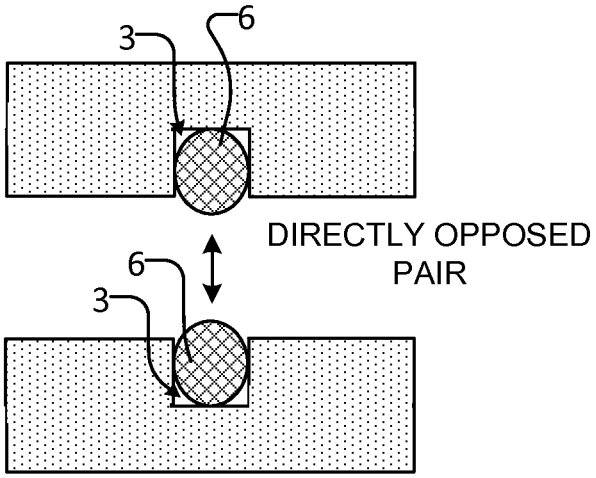
FIGS. 7A and 7B schematically depict two different configurations of opposed pluralities of balls, with FIG. 7A showing an opposed pair of balls and FIG. 7B showing an opposed triplet of balls.
Figure 7B:
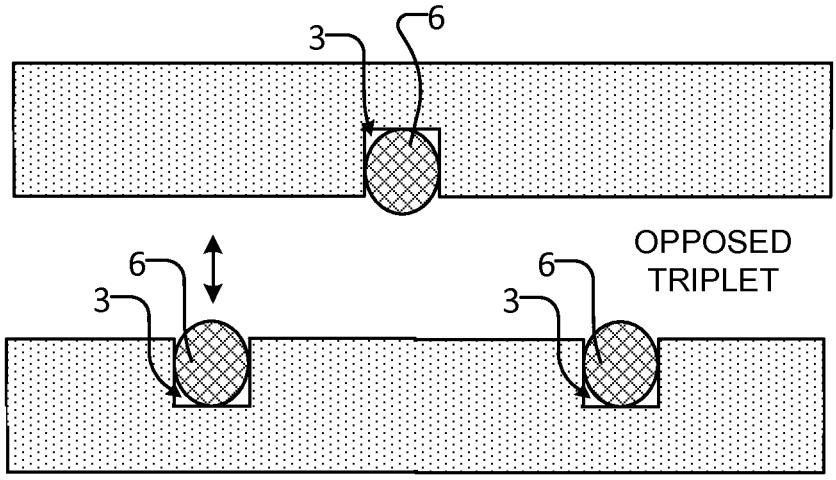

As shown best in FIG. 3, in addition to defining container concavity 7, interior surface 10 is shaped to define a plurality of ball-receiving concavities 3, which open into container cavity 7. Ball-receiving concavities 3 of container 20 may be of the same size or may be of different sizes. In the illustrated embodiment of FIGS. 1-3, case body 1 comprises twelve ball-receiving concavities 3 and cover 4 comprises four ball-receiving concavities 3. In general, however, container 20 may be provided with any suitable number of ball-receiving concavities 3. In currently preferred embodiments, container 20 comprises at least three pluralities of opposing ball-receiving concavities 3, with the three pluralities of generally opposing ball-receiving concavities oriented at least approximately orthogonally to one another. Such pluralities of opposing ball-receiving concavities 3 may comprise a pair of ball-receiving concavities 3 on directly opposing sides of container cavity 7 (as shown schematically in FIG. 7A). Such pluralities of opposing ball-receiving concavities 3 may additionally or alternatively comprise three or more ball-receiving concavities 3 comprising a pair of spaced-apart ball-receiving concavities 3 on one side of container cavity 7 and at least one ball-receiving concavity 3 on the opposing side of container cavity 7 and located between the pair of spaced-apart ball-receiving concavities 3 on the first side of container cavity 7 (as shown schematically in FIG. 7B).

Ball-receiving concavities 3 house elastically deformable balls 6. Balls 6 may be made from rubber or other deformable elastic material. In some embodiments, balls 6 may comprise a hollow elastically deformable boundary surface and may be filled with fluid (e.g. air, a suitable gel or liquid and/or the like). Balls 6 may all have the same size or may have different sizes which may correspond to different sizes of ball-receiving concavities 3 as described in more detail below. Balls 6 may all have the same elastic deformability properties as each other or may have different elastic deformability properties from one another.

Figure 4:
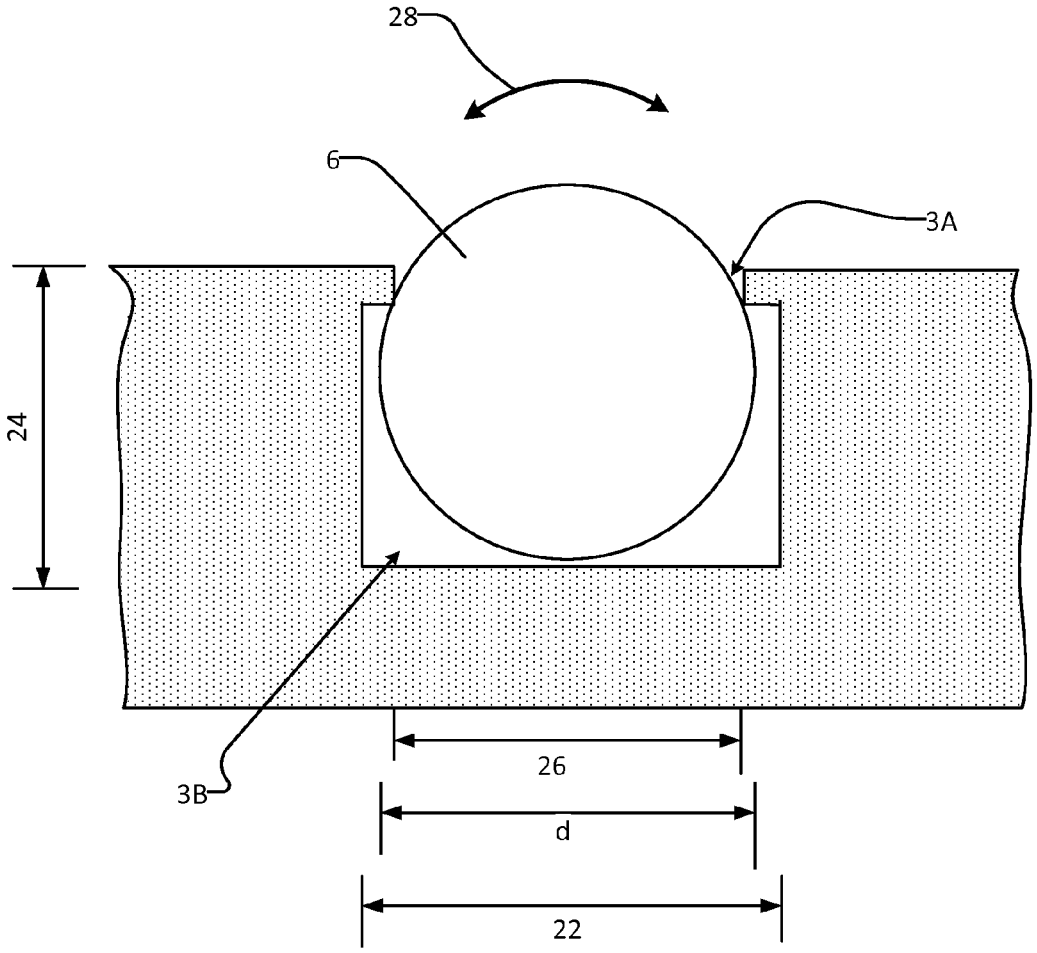
FIG. 4 is a side cross-sectional view of a ball-receiving concavity in the FIG. 1 container.

FIG. 4 schematically depicts a detailed cross-sectional view of a ball 6 in a ball-receiving concavity 3. As shown in FIG. 4, ball-receiving concavity 3 comprises an opening 3A located at the edge of ball-receiving concavity 3 (i.e. where ball-receiving concavity 3 opens into container cavity 7) and an interior region 3B located deeper inside ball-receiving concavity 3. Balls 6 are sized (relative to their corresponding ball-receiving concavity) to protrude from interior regions 3B of ball-receiving concavities 3 through openings 3A of concavities 3 and into container cavity 7. Container cavity 7 and/or balls 6 are sized such that when optical instrument 5 is placed into container cavity 7, the elastically deformable nature of balls 6 allows balls 6 to slightly compress (i.e. elastically deform) to accommodate optical instrument 5 in container cavity 7. Restorative forces associated with this deformation of balls 6 exert moderate forces on optical instrument 5, thereby loosely supporting optical instrument 5.

Preferably, balls 6 are located within container 20 such that various pluralities of balls 6 exert restorative forces, which tend to oppose one another. In currently preferred embodiments, container 20 comprises at least three pluralities of generally opposing balls 6, with the three pluralities of generally opposing balls 6 at least approximately orthogonally to one another. Such pluralities of opposing balls 6 may comprise a pair of balls on directly opposing sides of container cavity 7 (as shown schematically in FIG. 7A). Such pluralities of opposing balls 6 may additionally or alternatively comprise three or more balls 6 comprising a pair of spaced-apart balls 6 on one side of container cavity 7 and at least one ball 6 on the opposing side of container cavity 7 and located between the pair of spaced-apart balls 6 on the first side of container cavity 7 (as shown schematically in FIG. 7B).

Referring to FIG. 4, each of ball-receiving concavities 3 may be characterized by: an opening dimension (e.g. an opening width or opening diameter) 26 of its opening 3A; an interior dimension (e.g. an interior width or interior diameter) 22 of its interior region 3B; and a depth 24. In the example embodiment shown in FIG. 4, the opening dimensions 26 of the openings 3A of ball-receiving concavities 3 are narrower than the interior dimensions 22 of their interior regions 3B. Balls 6 received in ball-receiving concavities 3 may have diameters d which are larger than the opening dimensions 26 of the openings 3A of their corresponding ball-receiving concavities 3, but smaller than the interior dimensions 22 of the interior regions 3B of their corresponding ball-receiving concavities 3. The diameters d of balls 6 are greater than the depths 24 of their corresponding ball-receiving concavities 3. This ensures that balls 6 will protrude from the interiors 3B of ball-receiving concavities 3, through openings 3A and into container cavity 7.

Balls 6 may be sized or otherwise designed so that with sufficient external force, balls 6 may be inserted into, or removed from, ball-receiving concavities 3, but so that the force of gravity acting on balls 6 is insufficient to deform balls 6 by enough that balls 6 fall out of their corresponding ball-receiving concavities 3. Balls 6 dimensioned as described above and as shown in FIG. 4 may not be tightly fitted inside ball-receiving concavities 3. In contrast, balls 6 dimensioned as described above may be permitted to rotate (as shown by double-headed arrow 28 of FIG. 4) inside their respective ball-receiving concavities 3—e.g. due to transportation vibration or other external forces). Such rotational movement allows balls 6 to change their points/regions of contact with optical instrument 5 and with the walls of ball-receiving concavities 3, which may mitigate structural deterioration, distortion and/or loss of elasticity of balls 6 that could otherwise occur from being pressured continuously on the same surface points/regions.

Figure 5:
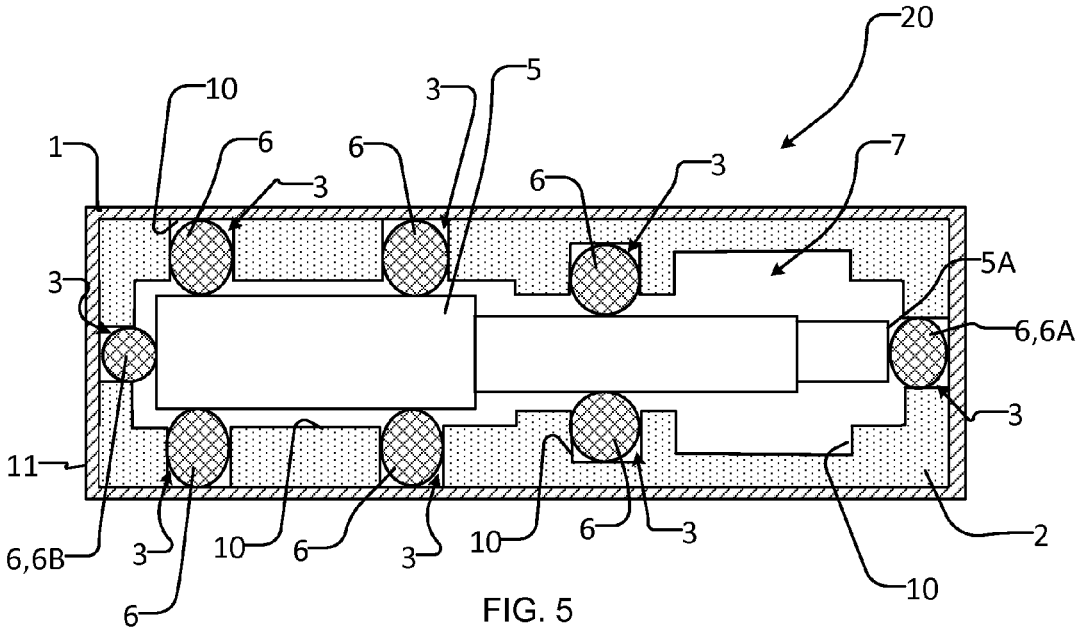
FIG. 5 is a schematic top cross-sectional view of the case of the FIG. 1 container.

As discussed above, ball-receiving concavities 3 are defined by interior surface 10 of container 20 and interior surface 10 may be provided by the surface of interior layer 2 and/or the surface of exterior layer 11. In some embodiments, ball-receiving concavities 3 are defined entirely by interior layer 2 of case body 1 and/or cover 4. In some embodiments, the sidewalls of ball-receiving concavities 3 are defined by interior layer 2 of case body 1 and/or cover 4 and the bases of ball-receiving concavities 3 are defined by exterior layer 11 of case body 1 and/or cover 4. In some embodiments (like the case of the illustrated embodiment, as shown best in FIGS. 5 and 6), there are some ball-receiving concavities 3 defined entirely by interior layer 2 and some ball-receiving concavities 3 defined in part by interior layer 2 and in part by exterior layer 11.

As shown in FIGS. 1 and 2, in some embodiments, the interior surface of interior layer 2 of case body 1 and/or cover 4 may have additional protrusions 13 and/or depressions 14. Protrusions 13 and depressions 14 may be of different sizes and shapes and may accommodate the shape of optical instrument 5 and may provide additional support for optical instrument 5.

Figure 6:
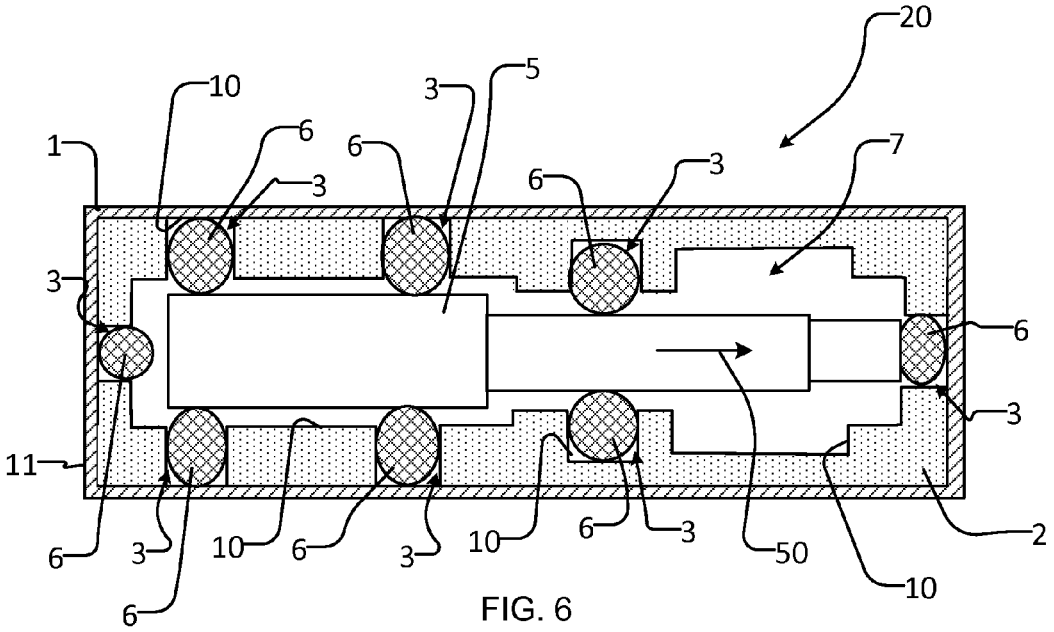
FIG. 6 is a schematic top cross-sectional view of the FIG. 1 container with the optical instrument moving along its optical axis inside the container.

Optical instrument 5 may move inside container 20 due, for example, to the application of external forces to container 20 during transport. FIG. 6 shows an example embodiment, where optical instrument 5 experiences movement along its optical axis (as shown by arrow 50). The movement of optical instrument 5 causes end 5A of optical instrument 5 to press against one of balls 6A, which in turn compresses elastically and exerts restorative forces against end 5A of optical instrument 5. As optical instrument 5 compresses ball 6A, the kinetic energy of optical instrument 5 is converted to elastic energy of ball 6A. As the kinetic energy is converted to elastic energy, optical instrument 5 gradually slows down until it comes to a full stop. At that point, all of the kinetic energy of optical instrument 5 is converted to elastic energy in ball 6A, taking into consideration that some of the energy may be dissipated as heat due to friction. Ball 6A then pushes against optical instrument 5 sending it in the direction of the opposing ball 6B. The process then repeats between optical instrument 5 and the opposing ball 6B until all the energy is ultimately converted into heat and optical instrument 5 comes to a stop.

Balls 6A, 6B may be chosen to have dimensions and elastic properties such that under a range of typical forces that might be experienced during transport, balls 6A, 6B will compress in a manner which prevents optical instrument 5 from contacting interior layer 2. The use of balls 6 may help reduce the transmission of shock forces to optical instrument 5 by gradually absorbing their energy. The elastic nature of balls 6 prevents the sudden impact of optical instrument 5 with interior layer 2 and hence, prevents damage to optical instrument 5.

As mentioned above, in currently preferred embodiments, container 20 comprises at least three pluralities of generally opposing balls 6 (housed in corresponding ball-receiving concavities 3), with the three pluralities of generally opposing balls 6 (and their ball-receiving concavities 3) oriented at least approximately orthogonally. In this description and the corresponding claims, a generally opposed plurality of balls 6 may comprise a pair of balls 6.

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof;

"herein", "above", "below", and words of similar import, when used to describe this specification shall refer to this specification as a whole and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A method for transporting an optical instrument, the method comprising:

providing a container for housing an optical instrument, the container comprising an interior surface shaped to define a container cavity, the container cavity sized to accommodate the optical instrument, the interior surface further shaped to define a plurality of ball-receiving concavities which open into the container cavity, each ball-receiving concavity having an opening at an edge between the ball-receiving concavity and the container cavity and an interior region inside the ball-receiving concavity;

providing a plurality of elastically deformable balls, each ball located in a corresponding one of the ball-receiving concavities and projecting from the interior region of the corresponding one of the ball-receiving concavities through the opening of the corresponding one of the ball-receiving concavities and into the container cavity; and inserting the optical instrument into the container concavity and thereby deforming the plurality of balls.

2. A method according to claim 1 wherein providing the container comprises dimensioning each ball-receiving concavity to have an interior dimension of its interior region and an opening dimensions of its opening, the opening dimensions less than the interior dimension.

3. A method according to claim 2 wherein providing the plurality of elastically deformable balls comprises, for each ball, dimensioning a diameter of the ball to be greater than the opening dimension of its corresponding ball-receiving concavity and less than the interior dimension of its corresponding ball-receiving concavity.

4. A method according to claim 1 wherein providing the plurality of elastically deformable balls comprises, for each ball, dimensioning the ball and its corresponding ball-receiving concavity relative to one another such that the ball is permitted to rotate in its corresponding ball-receiving concavity.

5. A method according to claim 1 comprising deforming each ball by hand to insert the ball into its corresponding ball-receiving concavity.

6. A method according to claim 5 wherein, for each ball, the force of gravity acting on the ball is insufficient to deform the ball enough to remove the ball from its corresponding ball-receiving concavity.

7. A method according to claim 1 wherein providing the container and providing the plurality of balls comprises locating the plurality of balls such that it comprises one or more pluralities of opposing balls.

8. A method according to claim 7 wherein locating the plurality of balls such that it comprises one or more pluralities of opposing balls comprises locating at least one pair of balls on opposing sides of the container cavity.

9. A method according to claim 7 wherein locating the plurality of balls such that it comprises one or more pluralities of opposing balls comprises locating a pair of spaced apart balls located on a first side of the container cavity and locating a ball on the opposing side of the container cavity and between the spaced apart pair of balls on the first side of the container cavity.

10. A method according to claim 7 wherein locating the plurality of balls such that it comprises one or more pluralities of opposing balls comprises locating three pluralities of opposed balls, with each of the three pluralities of opposed balls oriented generally orthogonally from one another.

* * * * *